US012220742B2

(12) United States Patent
Klesch

(10) Patent No.: US 12,220,742 B2
(45) Date of Patent: Feb. 11, 2025

(54) APPARATUS METHOD FOR LOCATING, CONTROLLING GEOMETRY, AND MANAGING STRESS OF HOT TOPS FOR METAL CASTING

(71) Applicant: PYROTEK, INC., Spokane, WA (US)

(72) Inventor: Jonathan Klesch, Spokane, WA (US)

(73) Assignee: Pyrotek, Inc., Spokane, WA (US)

( * ) Notice: Subject to any disclaimer, the term of this patent is extended or adjusted under 35 U.S.C. 154(b) by 25 days.

(21) Appl. No.: 18/028,172

(22) PCT Filed: Sep. 22, 2021

(86) PCT No.: PCT/US2021/051503

§ 371 (c)(1),
(2) Date: Mar. 23, 2023

(87) PCT Pub. No.: WO2022/066733

PCT Pub. Date: Mar. 31, 2022

(65) Prior Publication Data

US 2023/0364670 A1 Nov. 16, 2023

Related U.S. Application Data

(60) Provisional application No. 63/082,286, filed on Sep. 23, 2020.

(51) Int. Cl.

| | |
|---|---|
| ***B22D 7/10*** | (2006.01) |
| ***B22D 11/04*** | (2006.01) |
| *B22D 11/041* | (2006.01) |
| *B22D 11/049* | (2006.01) |

(52) U.S. Cl.
CPC ..... *B22D 7/106* (2013.01); *B22D 11/0401* (2013.01); *B22D 11/041* (2013.01); *B22D 11/049* (2013.01)

(58) Field of Classification Search
CPC ..... B22D 11/0401; B22D 7/10; B22D 7/106
See application file for complete search history.

(56) References Cited

U.S. PATENT DOCUMENTS

| | | | | |
|---|---|---|---|---|
| 1,668,567 A | | 5/1928 | Messler | |
| 2,835,943 A | | 5/1958 | Daley | |
| 2,863,192 A | * | 12/1958 | Kauffman, Sr. | B22D 7/10 249/106 |
| 3,186,042 A | * | 6/1965 | Daley | B22D 7/10 277/651 |
| 3,458,169 A | | 7/1969 | Eastwood et al. | |
| 3,540,689 A | | 11/1970 | La Bate | |
| 3,794,287 A | | 2/1974 | Atkinson | |
| 4,352,482 A | | 10/1982 | Duvall | |

FOREIGN PATENT DOCUMENTS

| | | | | |
|---|---|---|---|---|
| GB | 1461392 A | * | 1/1977 | B22D 7/106 |

OTHER PUBLICATIONS

International Search Report for Application No. PCT/US2021/051503, Mailed Dec. 29, 2021, 2 pages.
Written Opinion of the International Searching Authority, Mailed Dec. 29, 2021, 7 pages.

* cited by examiner

*Primary Examiner* — Kevin E Yoon
(74) *Attorney, Agent, or Firm* — Lippes Mathias LLP

(57) ABSTRACT

A method and apparatus used to achieve alignment during mold assembly and accommodate thermal expansion comprising employing a compressible region and a modified interface dimension.

18 Claims, 4 Drawing Sheets

APPARATUS METHOD FOR LOCATING, CONTROLLING GEOMETRY, AND MANAGING STRESS OF HOT TOPS FOR METAL CASTING

CROSS-REFERENCE TO RELATED APPLICATIONS

This application claims priority to U.S. Provisional Patent Application Ser. No. 63/082,286, filed on Sep. 23, 2020, which is incorporated by reference in its entirety.

BACKGROUND

The present invention relates to a hot top mold assembly device for use with a casting system. Hot top casting includes, but is not limited to, batch vertical direct chill (VDC) and continuous horizontal direct chill (HDC) casting. A direct chill casting system is described for example in U.S. Pat. No. 4,598,763.

Most casting machine variants include three main subassemblies including the metal distribution assembly, the mold assembly, and the base assembly. The distribution assembly delivers metal to the mold assemblies through apertures. In VDC designs, the metal distribution assembly contains the table weldment, distribution troughing (a.k.a. tabletop refractory), and often a nozzle (a.k.a. thimble). The liquid metal enters the distribution troughing and exists through apertures with or without nozzles into the mold assemblies fastened to the distribution assembly. The metal is partially solidified at the surface and near the surface within the mold assemblies that contain a mold body, mold, and hot top (a.k.a. transition plate). As the casting forms, it travels with the base assembly configured as starting heads mounted to single base weldment.

Travel of the base assembly is commonly facilitated by hydraulic cylinder(s) or a system of motors, pulleys, and cables. In HDC designs, the metal distribution assembly includes a tundish (a.k.a. headbox) that provides a reservoir to generate the desired head pressure of the metal. Either attached or integrated in the head box is a head plate (a.k.a. nozzle plate) with an aperture(s) for metal to exit into the mold assemblies. The mold assemblies contain the mold body, mold, and hot top (a.k.a. header plate). Like VDC machines, the metal is partially solidified inside the mold assembly and as the casting forms, it travels with the starting heads. Unlike VDC machines, the starting heads fall away after a determined length of the cast allowing for continuous casting operation.

Common hot top mold assemblies have three main components: (1) mold body, (2) mold, and (3) hot top. The mold body provides the structure of the assembly and is fixed to the casting machine. It is typically made of aluminum and often contains functional attributes to center starting heads (a.k.a. starting bases), channels for hydronic cooling distribution, and features to accommodate the other components of the assembly. The mold of the mold assembly has a precise geometry to form the final desired shape of the casting and is commonly made from graphite, aluminum or copper. It is internally positioned at an intermediate distance inside the mold body and is either mechanically fixed or installed under compression using an interference fit joint to the mold body. The mold is hydronically cooled via channels or ports in the mold body to generate the desired thermal gradient for metal solidification at or near the mold surface. Some mold technologies are designed to distribute casting lubricants and gas to further cool the component and improve surface quality of the casting either through small apertures bored through the cross-section or by utilizing the inherent porosity of the mold material (e.g. graphite).

The hot top creates a boundary to control fluid flow into and out of the slush and liquidus regions of the casting and to manage heat transfer by initiating cooling as the metal approaches the mold. They are geometrically centered inside the mold body and normal to the surface of the mold. Common hot top materials of construction include traditional ceramic materials (e.g. silicates) with or without fiber reinforcement. Hot tops are secured in the mold under clamping force with a single externally threaded ring or a radial array of screws and a clamping ring.

The casting process has two conditions, states, or phases. The first state is the transient period beginning at the start of the cast and ends when casting parameters are stable. The section of the casting produced during transient state is engineered scrap and is commonly referred to as the "butt" and has a length approximately equidistant to the cross-section. It has undesirable metallurgical properties and is discarded before further processing of the casting. During the transient state of casting, the metal flows through the aperture of the hot top onto the starting head that is temporarily positioned inside the mold assembly and cooled by secondary cooling water while in this starting position. The metal begins to solidify on the starting head and continues to fill and solidify until it reaches the primary solidification point on the mold. Then, the starting head begins moving at a slow rate out of the mold assembly. The solidified metal, or casting, that forms continues to travel with the starting head and is introduced to the secondary cooling water to completely solidify the shape. When thermal stability is achieved, the system transitions to steady state and the travel rate of starting head increases. This continues until the end of the cast and produces the desirable metallurgical properties commonly referred to as the product.

Disregarding the heat transfer demands of a hot top, there are two critical aspects that prove challenging with most of the technology available today. The first critical variable with negative consequence to casting is the fit of the hot top in the mold assembly. The component must precisely align with the mold and maintain transitions between adjacent components to prevent surface defects on the casting. The second aspect affects service life and risk of both failure of expected performance and catastrophic failure caused by fracture. During casting, the mold and mold assembly maintain low temperature and little to no thermal expansion. Conversely, the hot top and the distribution assembly troughing it is attached to experience metal temperatures in some regions and expand. Accommodation of this expansion through machine design practices of material selection and joint design is imperative to reduce, or eliminate, thermal stress from constraint during expansion.

Fit of the hot top is critical to successful casting during both transient and steady state casting conditions. For continuously lubricated technology, the geometry and orientation of the transition between the hot top and the mold of the mold assembly influence primary solidification. Misalignment commonly results in casting defects. Similarly, for gas cushioned technology, the orientation of the gas pocket geometry of the hot top, which is located at the transition of the hot top to the mold, must be consistent to eliminate casting surface defects. Proper alignment not only affects product quality, it has significant influence on the stress developed during casting. If the hot top is misaligned in the mold body, thermal stress is induced, or intensified where the joint allowance has been compromised. Further, all technologies must maintain a gap less than 0.4 mm at the interface between the hot top and the mold to eliminate the risk of metal penetration. Precise location of the hot top in the mold assembly is paramount to reducing casting surface defects.

The thermal transient and steady state condition of the hot top do not match that of the casting machine. The transient and steady-state periods of casting process are defined by the solidification of the casting. For hot tops, they are differentiated by a period of rapid thermal change and another of slow progression approaching equilibrium. From the beginning of a cast and sometime after the metal fills the mold, the hot top is in a transient state. The temperature at the metal contact area approaches metal casting temperature and by conductive heat transfer, energy passes through the body of the component toward the cold sinks including the water cooled mold assembly and the air space opposite the metal. During the transient state period, this thermal front moves form the metal contact surfaces in a sweeping motion toward the cold regions on the adjacent and opposite surfaces with an axis at the transition to the hot top and the mold. When the progression of this front approaches zero, steady state is achieved and thermal stability in the hot top is realized.

The transient period induces internal thermal stress compared to a combination of internal and external thermal stress during steady state. The typical high strength ceramic material variants used for hot tops provide an adequate factor of safety to manage the internal thermal stresses during both the transient and steady states. It is the thermal stress from external constraints that challenge the strength and toughness of the component. Consider that the mold body and mold are geometrically stable since they are cooled hydronically and, as mentioned previously, by convection of lubricant and gas passing through them. As the hot top expands it can create an interference with the mold or the mold body, depending on the configuration of the technology. This constraint induces intense compressive and radial stresses that often exceed the ultimate strength of the materials commonly used. These stresses lead to crack initiation and rapid fracture during the first cast or propagation as the component endures multiple casting cycles.

The molds are commonly installed into precision machined interfaces in the mold body by a medium drive force interference fit. Hot tops are installed with variations of locational fits including (1) locational clearance, (2) locational transition, and (3) locational interference. For assembly, the locational interference fit is optimal since it locates the hot top precisely; however, during casting it provides inadequate space for thermal expansion. The component is constrained upon installation at room temperature. When it is placed in service, thermal stresses immediately develop and intensify until the thermal gradient with the component has reached steady state. The locational transition fit helps to maintain alignment with the mold, but it provides little to no space for expansion. If some space is allocated, it is quickly consumed by the expanding hot top shortly after casting commences and thermal stress is developed. The locational clearance fit compromises alignment during assembly, but it does provide some space for expansion of the hot top. Smaller mold configurations with a locational clearance fit experience little to no thermal stress during steady state after thermal gradients have stabilized. However, in most configurations, the joint allowance is inadequate, and the hot top expands until constrained by interfacing components in the mold and thermal stress magnitudes increase.

As a result of the interference of the hot top during casting, the component temporarily distorts in the positive z direction. This is shown in the simulated stress plot of a typical large diameter VDC billet casting mold assembly shown above in FIG. 1. There are negative consequences to this distortion. While distorted, the typical joint allowance at the nozzle decreases and increases radial pressure on the component in a hoop direction. Further, the overhang of the nozzle increases. When this overhang is too large, the metal flow over the transition generates turbulence and consequently undulations of higher velocity metal directed toward the mold and primary solidification. This results in what is commonly called lapping and considered an undesirable surface defect that increases the shell zone thickness and scrap.

Compounding the challenge of managing the expansion of the hot top, the metal delivery assembly has significant influence on movement and thermal stress development of the component. The thermal expansion of refractory distribution troughing in VDC casting and head plates in HDC casting causes misalignment to the molds. Since the hot tops are fastened to these components of the metal distribution assembly, they move with them. This misalignment can be accommodated by incorporating expansion joints between the distribution assembly and the hot top of the mold assembly fitted with gasketing material (e.g. ceramic paper). However, configurations with both expansion joints and large distances between apertures suffer similarly to designs without them. During casting when these distribution assemblies approach equilibrium a unidirectional load is transferred through the hot top shifting it to one side of the mold assembly resulting in intense compression and rapid fracture.

Consistent production of quality castings and repeatable performance of hot tops can be achieved with the current invention, which includes a precise alignment of the component within the mold and expansion allowance to accommodate both geometric changes and orientation of the hot top from increased temperatures during casting of the component itself and those it is attached to, as described below.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

In one illustrative embodiment, a hot top mold assembly system, comprising a hot top containing a hot top dimension altered to create a locational clearance fit between the hot top and a mold or a mold assembly is disclosed.

In another embodiment, a hot top for use in a hot top mold assembly system is disclosed wherein the hot top comprises a feature to restrain and locate a compressible component of the hot top.

In another embodiment, a hot top for use in a hot top mold assembly system is disclosed wherein the hot top comprises a hot top dimension altered to create a locational clearance fit between the hot top and a mold or a mold assembly. In addition, the hot top includes a feature to restrain or locate a compressible component of the hot top.

In yet another embodiment, a method to reduce thermal stress of a hot top is disclosed. The method comprises altering a hot top dimension to create a locational clearance fit between the hot top and a mold or a mold assembly.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
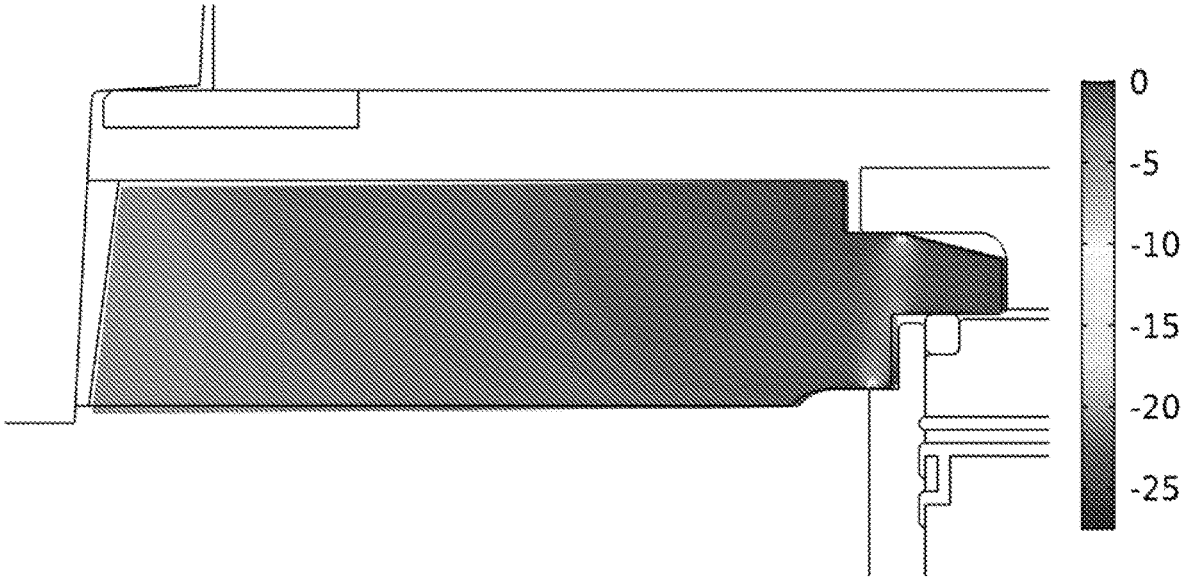
FIG. 1 shows a steady state third principal stress [MPa] stress plot of an improved method VDC hot top showing low stress magnitudes and downward distortion of the component.

A more complete understanding of the components, processes and apparatuses disclosed herein can be obtained by reference to the accompanying drawing. The figure is merely a schematic representation based on convenience and the ease of demonstrating the present disclosure, and is, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure.

The singular forms "a," "an," and "the" include plural referents unless the context clearly dictates otherwise.

As used herein, the terms about, generally and substantially are intended to encompass structural or numerical modifications which do not significantly affect the purpose of the element or number modified by such term.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any impurities that might result therefrom, and excludes other ingredients/steps.

Disclosed herein is a method to achieve alignment during mold assembly and accommodate thermal expansion employing a compressible or deformable region and a modified interface dimension. Upon installation, some of the compressibility or deformability range of the compressible or deformable region is consumed by a locational interference fit. The small magnitude of pressure induced on the hot top is negligible due to the high compressibility or deformability of the material deployed. During casting, the compressibility or deformability range is further consumed as the hot top and other components of influence expand. However, by design, the range is not fully consumed and consequently, only minor pressures on the hot top are realized. This method eliminates interference of the hot top and mold assembly or mold during casting and results in significant reduction of thermal stress that develops. In addition, by eliminating the interference, the positive z direction of distortion is eliminated and slightly reversed to increase the joint allowance between the hot top and the nozzle that accommodates expansion of the nozzle and closely maintaining the overhang of the nozzle to reduce the risk of lapping defects on the casting.

FIG. 1 shows a steady state third principal stress [MPa] stress plot of an improved method VDC hot top showing low stress magnitudes and downward distortion of the component, a result of the use of an embodiment of the current invention.

In one embodiment of the invention, the apparatus utilizes an assembly comprised of a modified hot top dimension and a deformable feature that is a compressible component fitted to the hot top or includes elements intended to fracture from the hot top to allow for thermal expansion. The hot top dimension is altered to create a significant locational clearance fit between the hot top and the mold or mold assembly.

In another embodiment, the apparatus contains a deformable feature and a modified hot top dimension to create a significant locational clearance fit between the hot top and the mold or mold assembly.

In another embodiment, a hot top dimension at ambient temperature to eliminate thermal stress during casting at casting temperature ($S_O$) is expressed as:

$$M_O \leq S_O \leq \frac{I_O}{1 + 0.833\alpha\Delta T}$$

where $M_O$ is the mold dimension at ambient temperature, $I_O$ is the mold interface dimension at ambient temperature, a is a coefficient of thermal expansion of bulk hot top material, and $\Delta T$ is temperature change between ambient temperature and casting temperature.

where $\beta$ is the mold interface dimension, a is the coefficient of thermal expansion of the bulk hot top material, and $\Delta mT$ is temperature change between ambient and casting temperature.

Further modifications may include a feature (e.g. gland, groove) to restrain and locate the compressible component of the assembly. The compressible component is made from materials with either small bulk moduli or high elasticity including, but not limited to, ceramic, ceramic paper, ceramic braided rope, rubber, or polymer. To prevent development of undesirable localized pressure, or contact stress, the compressible component must deflect under pressure below 65 kPa.

Figure 2:
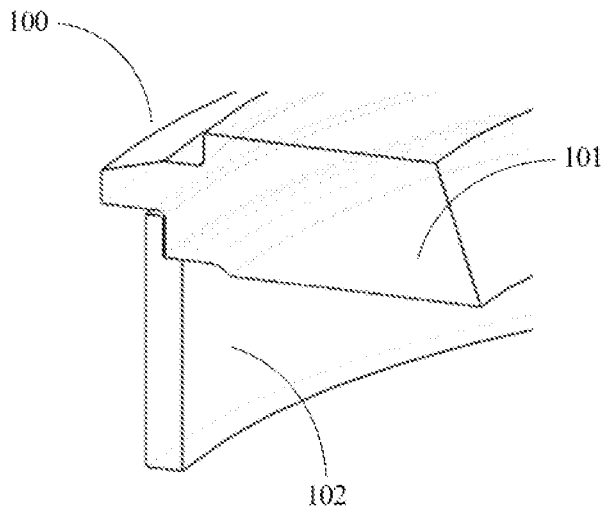
FIG. 2 shows a side view of a prior art hot top mold assembly device.

FIG. 2 shows a side view of a typical hot top assembly device 100 which shows a hot top 101 and mold 102 configuration as utilized in the prior art in a VDC system. As can be seen, the hot top 101 diameter is not reduced and there is no feature to restrain and locate a compressible component nor a deformable feature to accommodate thermal expansion at elevated temperatures.

Figure 3:
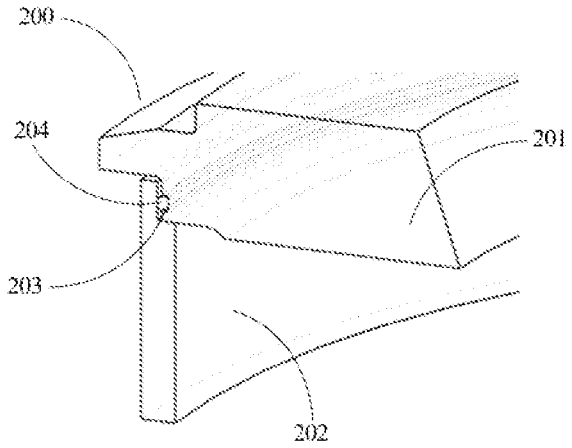
FIG. 3 shows a side view of a hot top mold assembly device.

FIG. 3 shows a side view of an embodiment of the current invention wherein the hot top assembly device 200 includes an improved hot top 201 that includes a reduced hot top diameter at the interface of interest with the mold 202 and a gland feature 203 as a part of the hot top 201 wherein the gland feature 203 includes a compressible O-Ring 204. In one embodiment, the hot top 201 comprises a feature to restrain and locate a compressible component of the hot top 201. As shown in FIG. 3, the feature is a gland feature 203, however, a groove feature, or similar feature would also be acceptable. The compressible component can comprise any of a number of appropriate materials with small bulk moduli or high elasticity such as ceramic paper, ceramic braided rope, rubber, and polymer. As shown in FIG. 3, the compressible feature is an O-Ring 204 that can be made of any appropriate material.

Figure 4:
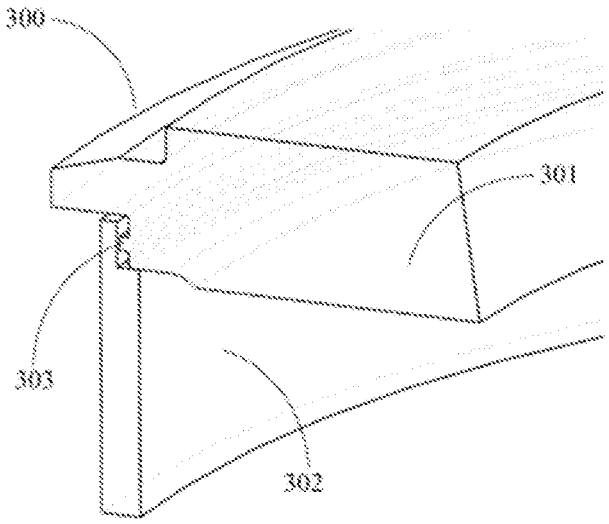
FIG. 4 shows a side view of a hot top mold assembly device.

FIG. 4 shows a side view of an embodiment of the current invention wherein the hot top assembly device 300 includes an improved hot top 301 that includes a reduced hot top diameter at the interface of interest with the mold 302 and a deformable feature 303 of the improved hot top 301 body that deforms when the improved hot top 301 expands or is displaced at elevated temperatures experienced during casting. The deformable feature 303 is compressible or includes elements intended to fracture from the hot top 301 body to allow for thermal expansion.

In one embodiment, to prevent development of undesirable localized pressure, or contact stress, the compressible component deflects under pressure below 65 kPa. In another embodiment, the compressible component deflects pressure below 50 kPa. In yet another embodiment, the compressible component deflects pressure below 35 kPa.

The current invention will drastically improve hot top performance by simplifying the installation process and increasing confidence in proper hot top location. Further, it reduces or eliminates thermal stress to extend service life and reduce the risk of catastrophic failure. Lastly, it increases the likelihood of quality casting by preventing unwanted distortion in large format hot top geometries.

The exemplary embodiments described and claimed herein is not to be limited in scope by the specific embodiments herein disclosed since these embodiments are intended as illustrations. Any equivalent embodiments are intended to be within the scope of this application. Indeed, various modifications in addition to those shown and described herein will become apparent to those skilled in the art from the foregoing description. Such modifications are also intended to fall within the scope of the appended claims. All publications cited herein are incorporated by reference in their entirety.

To aid the Patent Office and any readers of this application and any resulting patent in interpreting the claims appended hereto, applicants do not intend any of the appended claims or claim elements to invoke 35 U.S.C. 112(f) unless the words "means for" or "step for" are explicitly used in the particular claim.

The invention claimed is:

1. A hot top mold assembly system, comprising:

a hot top and a mold, said hot top including a dimension creating a locational clearance fit between the hot top and the mold, the hot top including a collar configured to mate with an end of the mold and a depending edge configured to interface with an internal wall of the mold, wherein the edge includes a deformable feature to improve alignment during assembly of the hot top with the mold and accommodate thermal expansion, wherein the locational clearance fit of the hot top dimension at ambient temperature ($S_O$) is expressed as:

$$M_O \leq S_O \leq \frac{I_O}{1 + 0.833\alpha\Delta T}$$

wherein $M_O$ is a mold dimension at ambient temperature; $I_O$ is a mold interface dimension at ambient temperature; $\alpha$ is a coefficient of thermal expansion of bulk hot top material; and $\Delta T$ is temperature change between ambient temperature and casting temperature.

2. The hot top of claim 1 wherein the deformable feature includes elements intended to fracture from the hot top or is a compressible component to allow for thermal expansion.

3. The hot top of claim 2 wherein the feature is an O-ring disposed in a gland, shoulder, or a groove.

4. The hot top of claim 2 wherein the compressible component comprises materials with either small bulk moduli or high elasticity.

5. The hot top of claim 2 wherein the compressible component is at least one of ceramic, rubber, and polymer.

6. The hot top of claim 2 wherein the compressible component deflects at a pressure below 65 kPa.

7. The hot top of claim 2 wherein the compressible component deflects at a pressure below 50 kPa.

8. The hot top of claim 2 wherein the compressible component deflects at a pressure below 35 kPa.

9. A hot top for use in a hot top mold assembly system, the hot top comprising:

a hot top configured to create a locational clearance fit between the hot top and a mold, the hot top including a annular wall configured to penetrate an opening of the mold assembly, a collar extending radially from an intersection with the annular wall, the collar configured to engage an end surface of the opening of the mold, wherein the annular wall further comprises a feature to restrain or locate a compressible component of the hot top, wherein the locational clearance fit of the hot top dimension at ambient temperature ($S_O$) is expressed as:

$$M_O \leq S_O \leq \frac{I_O}{1 + 0.833\alpha\Delta T}$$

wherein $M_O$ is a mold dimension at ambient temperature; $I_O$ is a mold interface dimension at ambient temperature; $\alpha$ is a coefficient of thermal expansion of bulk hot top material; and $\Delta T$ is temperature change between ambient temperature and casting temperature.

10. The hot top of claim 9 wherein the feature is a gland, shoulder, or a groove.

11. The hot top of claim 9 wherein the compressible component comprises materials with either small bulk moduli or high elasticity.

12. The hot top of claim 9 wherein the compressible component is at least one of ceramic, rubber, and polymer.

13. The hot top of claim 9 wherein the compressible component deflects at a pressure below 65 kPa.

14. The hot top of claim 9 wherein the compressible component deflects at a pressure below 50 kPa.

15. The hot top of claim 9 wherein the compressible component deflects at a pressure below 35 kPa.

16. The hot top of claim 9 wherein the compressible component provides centering of the hot top and accommodates thermal expansion.

17. The hot top of claim 9 wherein the compressible component includes elements intended to fracture from the hot top to allow for thermal expansion.

18. A method to reduce thermal stress of a hot top comprising providing a locational clearance fit between the hot top and a mold, wherein the locational clearance fit of the hot top dimension at ambient temperature ($S_o$) is expressed as:

$$M_O \leq S_O \leq \frac{I_O}{1 + 0.833\alpha\Delta T}$$

wherein $M_O$ is a mold dimension at ambient temperature;

$I_O$ is a mold interface dimension at ambient temperature;

$\alpha$ is a coefficient of thermal expansion of bulk hot top material; and $\Delta T$ is temperature change between ambient temperature and casting temperature.

* * * * *